US011795655B1

(12) United States Patent
Keigley

(10) Patent No.: US 11,795,655 B1
(45) Date of Patent: Oct. 24, 2023

(54) BUCKET APPARATUSES, SYSTEMS, AND METHODS FOR ZERO TURN WORK MACHINES

(71) Applicant: ABI ATTACHMENTS, INC., Mishawaka, IN (US)

(72) Inventor: Kevin V. Keigley, Osceola, IN (US)

(73) Assignee: ABI Attachments, Inc., Mishawaka, IN (US)

( * ) Notice: Subject to any disclaimer, the term of this patent is extended or adjusted under 35 U.S.C. 154(b) by 116 days.

(21) Appl. No.: 17/448,055

(22) Filed: Sep. 20, 2021

Related U.S. Application Data

(60) Provisional application No. 63/080,836, filed on Sep. 21, 2020.

(51) Int. Cl.
*E02F 3/34* (2006.01)

(52) U.S. Cl.
CPC ..... *E02F 3/3411* (2013.01)

(58) Field of Classification Search
None
See application file for complete search history.

(56) References Cited

U.S. PATENT DOCUMENTS 2,364,121 A 12/1944 Arps
2,402,908 A 6/1946 Neville et al.
2,415,892 A 2/1947 Koehl et al.
2,441,070 A 5/1948 Hoover
2,449,212 A 9/1948 Fraga
2,465,476 A 3/1949 Pokorny et al.
2,496,874 A 2/1950 Holopainen
2,501,797 A 3/1950 Ulrich
2,543,496 A 2/1951 Holopainen
2,624,481 A 1/1953 Richey
2,679,943 A 6/1954 Stueland
2,712,389 A 7/1955 Sewell et al.
3,127,999 A 4/1964 Gostomski
3,362,554 A * 1/1968 Fortier ..... A01C 3/04 37/405
3,851,780 A 12/1974 Martin
4,318,653 A 3/1982 Benefield et al.
4,687,407 A * 8/1987 Osborne ..... E02F 3/627 172/473
4,915,575 A 4/1990 Tangenfeld et al.
5,364,224 A 11/1994 Padgett
6,663,338 B1 * 12/2003 Gregory, Jr. ..... E02F 3/962 414/920

(Continued)

*Primary Examiner* — Michael S Lowe
(74) *Attorney, Agent, or Firm* — Taft Stettinius & Hollister LLP

(57) ABSTRACT

A work machine is operatively coupled with a bucket attachment. A lift mechanism coupled with the work machine is adjustable to a plurality of Z-axis positions. The bucket attachment includes a bucket rotatably coupled with a frame. The frame is rotatably coupled with a rear end of the work machine and is coupled with the lift mechanism by at least one flexible rigging. The lift mechanism is adjustable to a first position in which the frame is rotated so that the bucket contacts the underlying ground surface and the flexible rigging does not support any of a weight of the frame and to a second position in which the frame is rotated so that the bucket is raised above the underlying ground surface and the flexible rigging supports at least a portion of the weight of the frame.

20 Claims, 12 Drawing Sheets

(56) References Cited

U.S. PATENT DOCUMENTS

| | | | | |
|---|---|---|---|---|
| 7,464,528 | B1 * | 12/2008 | Street | A01B 51/026 56/371 |
| 2004/0146389 | A1 | 7/2004 | Bares et al. | |
| 2006/0124328 | A1 | 6/2006 | Schager | |
| 2006/0182591 | A1 | 8/2006 | Hackett et al. | |
| 2009/0091101 | A1 | 4/2009 | Leonard et al. | |
| 2016/0090130 | A1 | 3/2016 | Nakao et al. | |
| 2019/0185077 | A1 | 6/2019 | Smith et al. | |

* cited by examiner

BUCKET APPARATUSES, SYSTEMS, AND METHODS FOR ZERO TURN WORK MACHINES

CROSS-REFERENCE

The present application claims the benefit of and priority to U.S. Application No. 63/080,836 filed Sep. 21, 2020, the disclosure of which is hereby incorporated by reference.

BACKGROUND

The present disclosure relates generally to bucket apparatuses, systems, and methods for zero turn work machines. A number of buckets have been proposed for use with work machines including, for example, front loader-type bucket machines, excavator-type bucket machines, and tilt or dump bucket machines, among other types of bucket machines. Heretofore, proposals have suffered from a number of drawbacks and disadvantages including those respecting their ability to be used with light-duty work machines including light-duty, zero turn work machines. There remains a substantial need for the unique apparatuses, systems, and methods disclosed herein.

DISCLOSURE OF EXAMPLE EMBODIMENTS

For the purposes of clearly, concisely, and exactly describing example embodiments of the present disclosure, the manner, and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created and that the invention includes and protects such alterations, modifications, and further applications of the exemplary embodiments as would occur to one skilled in the art.

SUMMARY OF THE DISCLOSURE

Certain embodiments comprise unique bucket apparatuses, methods, and/or systems for zero turn work machines. Other embodiments, forms, objects, features, advantages, aspects, and benefits shall become apparent from the following description and drawings.

DETAILED DESCRIPTION OF EXAMPLE EMBODIMENTS

Figure 1:
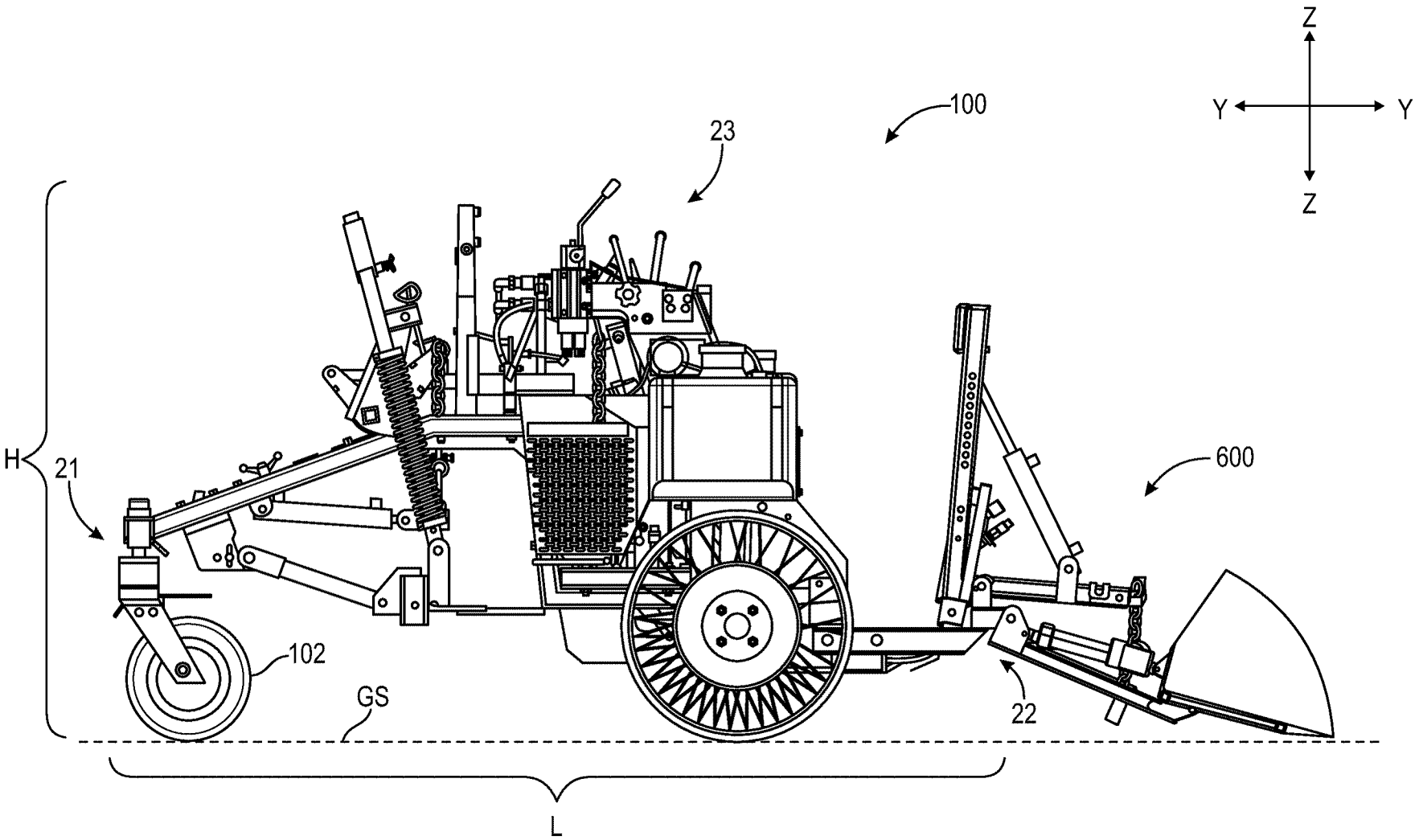
FIG. 1 is a side view of an example system comprising a work machine and a bucket attachment.
Figure 2:
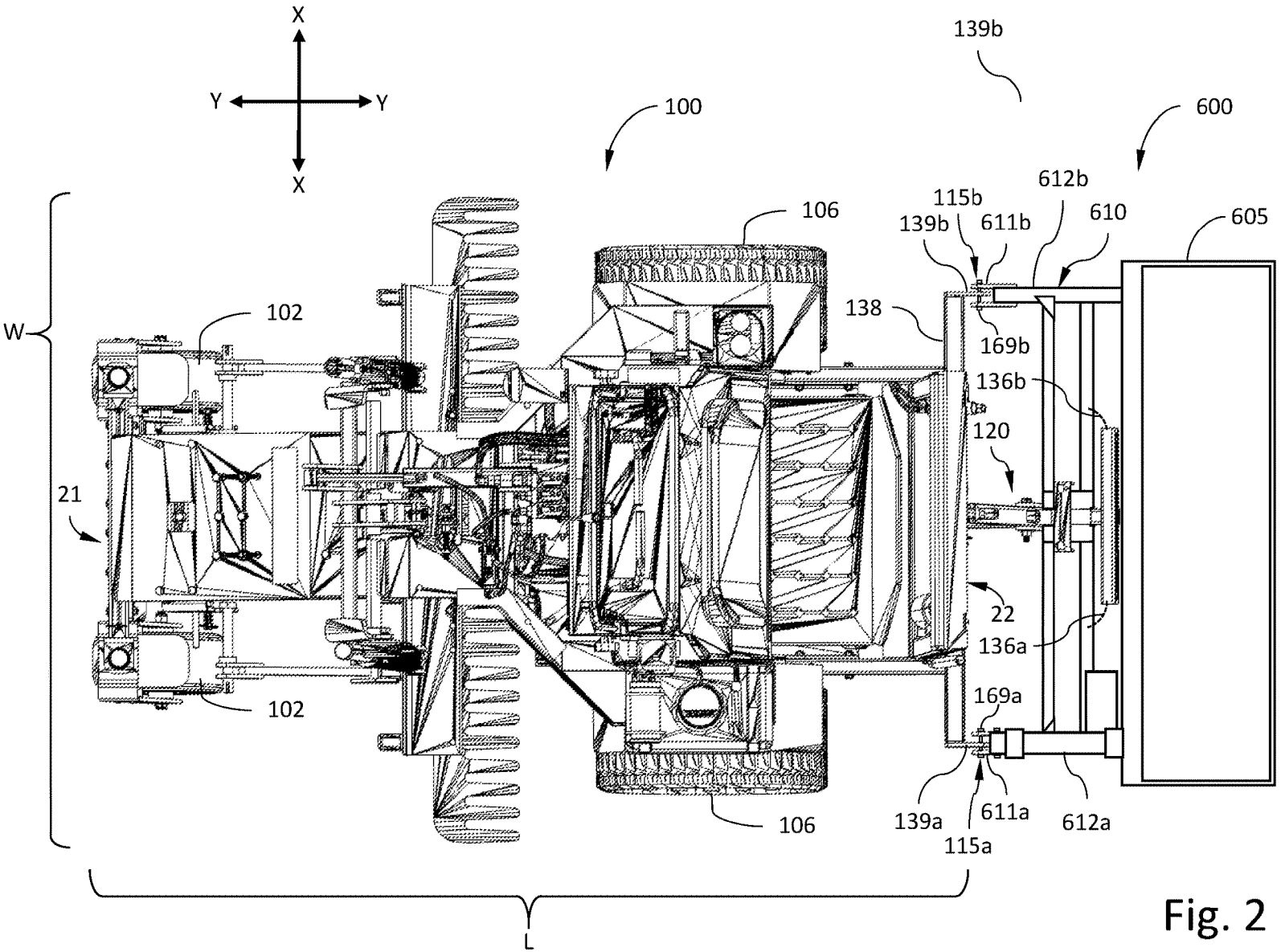
FIG. 2 is a top view of the example system of FIG. 1.

With reference to the figures and with initial reference to FIGS. 1 and 2, there is illustrated an example system comprising a bucket attachment 600 operatively coupled a work machine 100. The work machine 100 includes a front end 21, a rear end 22, and a plurality of ground-contacting wheels including non-driven front wheels 102 and driven rear wheels 106 which are rotatably coupled with a chassis of the work machine and which are configured to allow the work machine 100 to turn the work machine about a zero turning radius, The work machine 100 is provided in a form factor extending along a width W in the X-axis direction of the illustrated X-Y-Z coordinate system, a length L in the Y-axis direction of the illustrated X-Y-Z coordinate system, and a height H in the Z-axis direction of the illustrated X-Y-Z coordinate system.

In the illustrated embodiment, the work machine 100 is a self-propelled, zero turn radius work machine. In certain forms, the work machine 100 may be configured as a zero turn radius work machine as described in U.S. Pat. Nos. 9,332,687 and 9,883,621 the disclosures of which are incorporated herein by reference. In other embodiments, various other types of work machines may be utilized, such as other types of zero turn radius work machines.

A lift mechanism 120 is adjustably coupled with the work machine 100 and is adjustable to a plurality of Z-axis positions. In the illustrated embodiment, the lift mechanism 120 includes an actuator 122 in the form of a hydraulic cylinder which is coupled with a lifting arm 114 at a joint 104 permitting rotation of the actuator 122 relative to the lifting arm 114. The actuator 122 is also coupled with a vertically extending operator support member 127 of the work machine 100 at a joint 103 permitting rotation of the actuator 122 relative to the operator support member 127. The lifting arm 114 is coupled with a frame member 129 of the work machine 100 at a joint 105 permitting rotation of the lifting arm 114 relative to the frame member 129. In the illustrated embodiment, the joints 103, 104, 105 are provided as hinge-type joints, it being appreciated that other types of joints permitting the described relative rotation of the aforementioned coupled structures may be utilized in other embodiments.

The lifting arm 114 and the actuator 122 are examples of a lift arm rotatably coupled with a work machine and an actuator rotatably coupled with the lift arm and the work machine, the actuator being actuatable to rotate the lift arm to the plurality of Z-axis positions. Other embodiment may additionally or alternatively comprise other types of such lifting arms and lifting arm arrangements, for example, lifting arms with differently-arranged joints or fulcrums, vertically translating arms, vertically extensible and retractable arms, and other types of lift arms as will occur to one of skill in the art with the benefit of the present disclosure. Other embodiment may additionally or alternatively comprise other types of actuators, for example, linear motor actuators, rotary motor actuators, manually driven actuators, pneumatically drive actuators, electromagnetic actuators, or other types of actuators as will occur to one of skill in the art with the benefit of the present disclosure.

Figure 11:
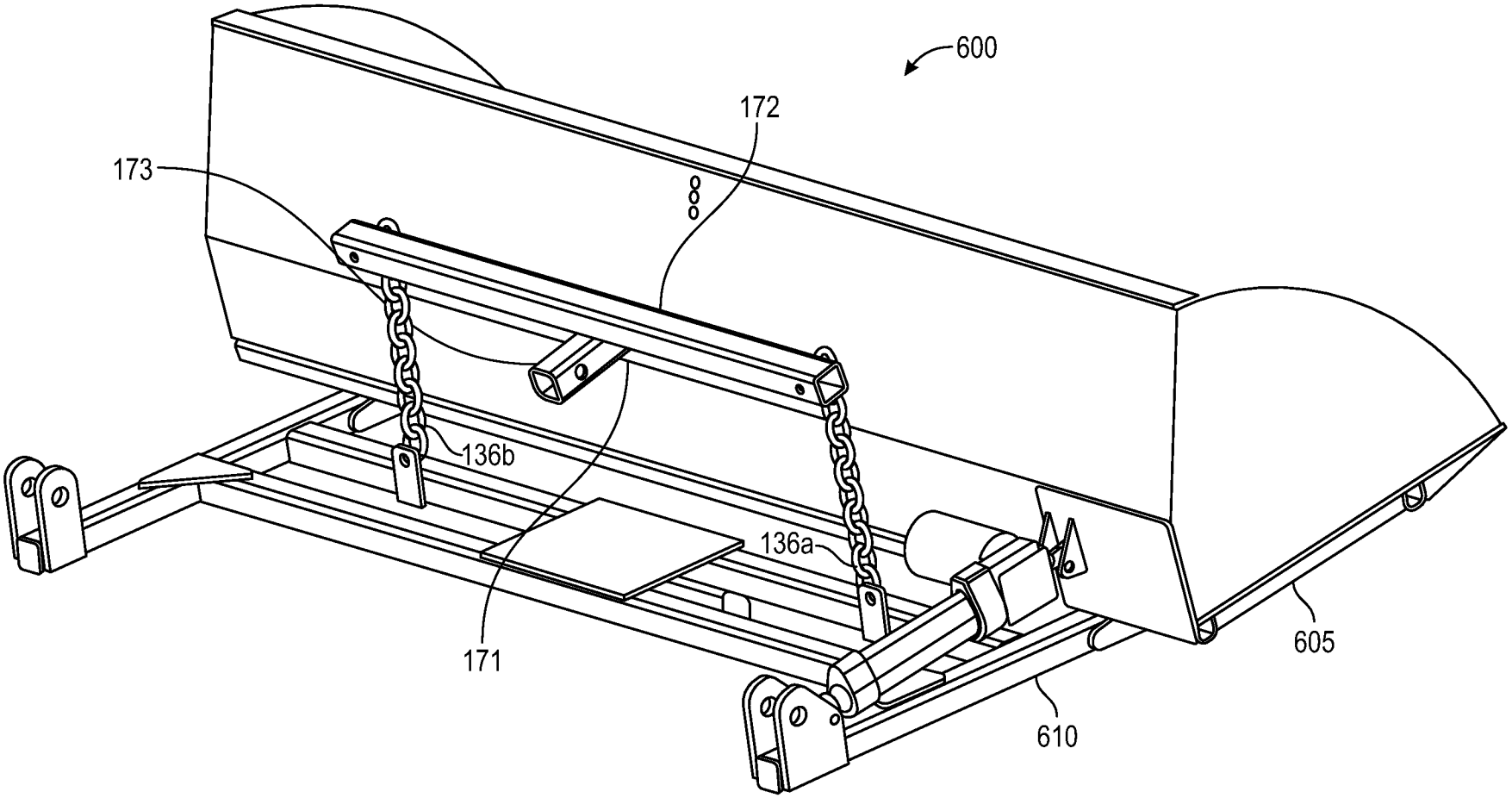
FIG. 11 is a perspective view of a portion of the example system of FIG. 1.
Figure 12:
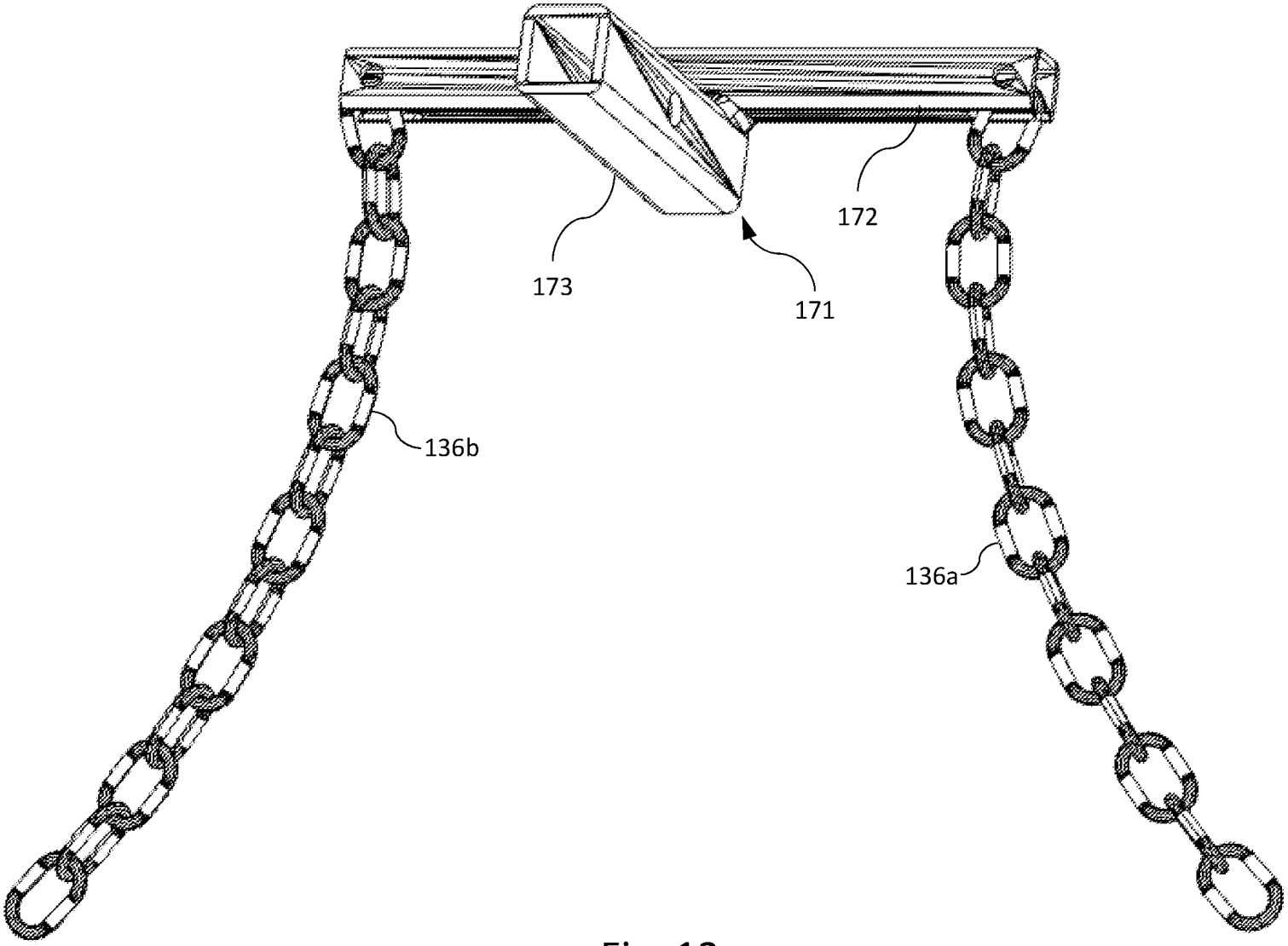
FIG. 12 is a perspective view of a portion of the example system of FIG. 1.

As illustrated most plainly in the views of FIGS. 11 and 12, a connector bar 171 may be coupled with the lifting arm 114. In the illustrated embodiment, the connector bar 171 is provided in an example T-bar configuration and includes a lateral bar member 172 which is coupled with flexible riggings 136*a*, 136*b*, and a longitudinal bar member 173 which is coupled with and extends longitudinally forward of the lateral bar member 172 and is received by and coupled with the lifting arm 114. The first flexible rigging 136*a* is coupled with and extends between the connector bar 171 and a lateral frame member 614 of the bucket attachment 600. In the illustrated embodiment a second flexible rigging 136*b* is coupled with and extends between the connector bar 171 and the lateral frame member 614 of the bucket attachment 600. In other embodiments, a single flexible rigging may be utilized. In the illustrated embodiment, the flexible riggings 136*a* and 136*b* comprise lengths of chain. In other embodiments, the flexible riggings 136*a* and 136*b* may comprise cables, lines, ropes, wires, or other types of flexible riggings.

The connector bar 171 provides a single connection hookup for coupling the flexible riggings 136*a*, 136*b* with the lifting arm 114. Thus, the connector bar 171 permits a plurality of flexible riggings 136*a*, 136*b* to be coupled with the work machine 100 via a single connection and a single connecting pin simplifying connection and disconnection of the bucket attachment 600 with the work machine 100 as well as the connection and disconnection of other tools with the work machine 100. The connector bar 171 similarly simplifies the connection and disconnection of the bucket attachment 600 with the work machine 100. It shall be appreciated, however, that one or more flexible riggings, such as flexible riggings 136*a*, 136*b*, may be coupled with a lifting mechanism, such as the lifting arm 114, and with a bucket attachment, such as the bucket attachment 600, by a variety of types of connecting and coupling arrangements and structures.

The lift mechanism 120 provides an example of a lift mechanism that is adjustable to a first position in which the frame 610 is rotated so that the bucket 605 contacts the underlying ground surface GS and the flexible riggings 136*a*, 136*b* are relaxed, slack, or otherwise do not support any of weight of the frame 610 or the bucket 605, for example, the position illustrated in FIGS. 1-2, 4-5, and 10 or other lowered positions. In such positions the flexible riggings 136*a*, 136*b* do not transfer force between the work machine 100 and the bucket attachment 600. Thus, for example, the bucket attachment 600 can be lowered into contact with the underlying ground surface GS without transferring any force in an upward Z-axis direction due to operation of the lift mechanism to lower the bucket attachment 600. Such force transfer, as would occur due to lowering a bucket with a rigid link, would reduce the traction of wheels with the underlying ground surface GS as occurs, for example, via the use of a front end loader or other conventional systems.

Figure 10:
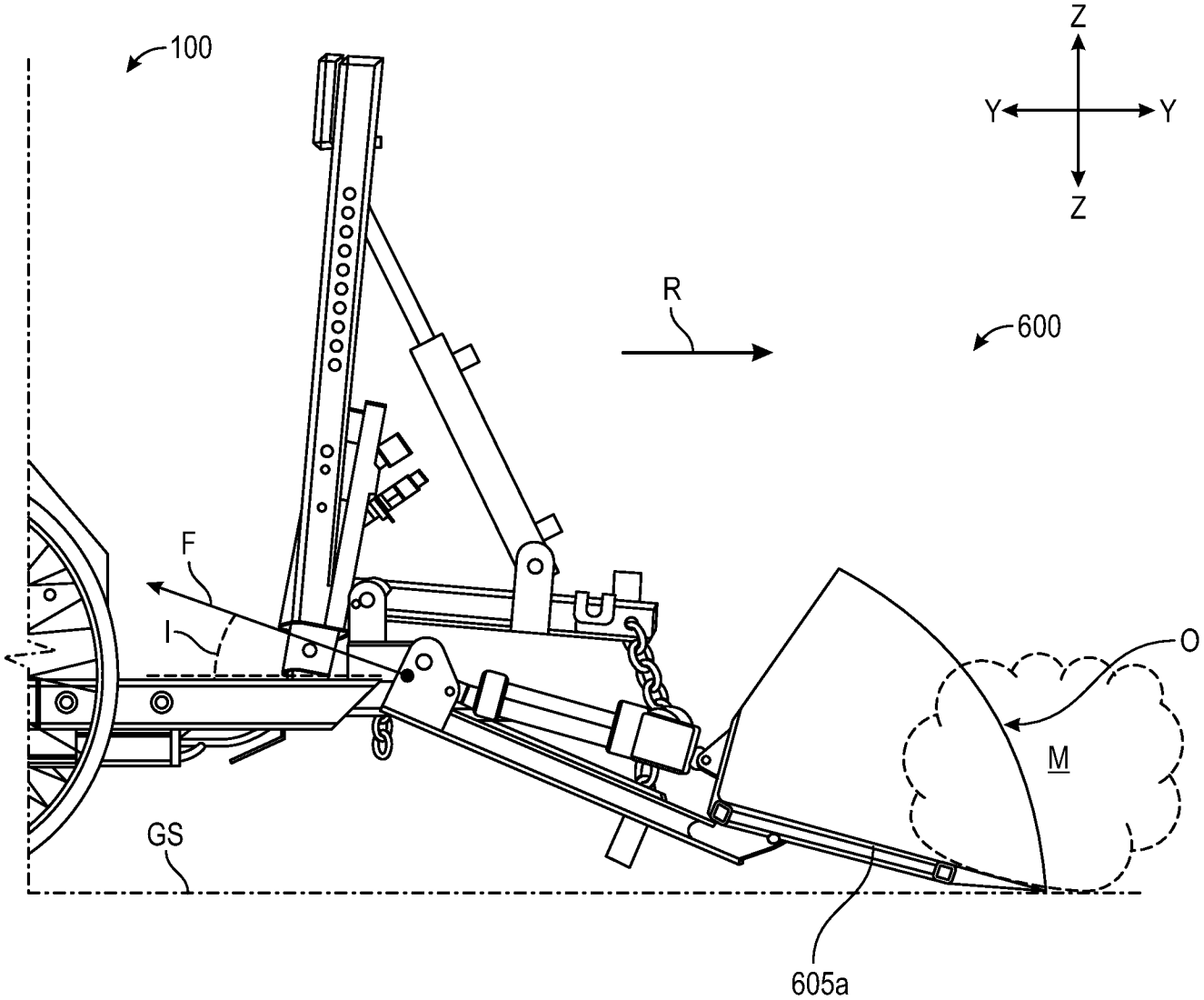
FIG. 10 is a side view of a portion of the example system of FIG. 1 performing an example operation.

It shall be appreciated that the position illustrated in FIGS. 1-2, 4-5, and 10, or other lowered positions wherein the lift mechanism 120 is adjusted to the first position and the frame 610 rotated so that the bucket 605 contacts the underlying ground surface, are examples of material loading positions in which at least a portion of a bottom side 605*a* the bucket 605 contacts the underlying ground surface GS and the bucket 605 is oriented to load and receive material M through the opening in O the Y-axis direction when the coupled combination of the work machine 100 and the bucket attachment 600 is driven in a reverse direction R, for example as illustrated in FIG. 10.

A number of loading positions of the bucket 605 are contemplated. In a first loading position, the lift mechanism 120 is adjusted to a first lift mechanism loading position, and the frame 610 is rotated so that the bucket 605 contacts the underlying ground surface and the flexible riggings 136*a*, 136*b* are slack or relaxed. In the first loading position, the bucket 605 will tend to travel or float over a hard underlying ground surface, such as concrete, asphalt, or heavily compacted material, and will tend to dig into softer underlying ground surface to some degree which may be restricted by the amount of slack in the flexible riggings 136*a*, 136*b*. Thus, while the bucket attachment 600 is primarily focused on scooping of loose material situated on an underlying grounds surface, and then the bucket 605 may be referred to as a scoop bucket, a degree of digging or excavation action may be achieved by the bucket attachment 600 and the bucket 605 coupled with work machine 100.

In a second loading position, the lift mechanism 120 is adjusted to a second lift mechanism loading position, and the frame 610 is rotated so that the bucket 605 contacts the underlying ground surface and the flexible riggings 136*a*, 136*b* are taut. In the second loading position, the bucket 605 will tend to travel or float over a hard underlying ground surface such as concrete, asphalt, or heavily compacted material, and will also travel along a softer underlying ground surface without digging into such a surface. Thus, the bucket attachment 600 coupled with work machine 100 may be adjusted to avoid digging operation if desired.

In a number of third loading positions, the lift mechanism 120 is adjusted to one of a number of a third lift mechanism loading positions, and the frame 610 is rotated so that the bucket 605 is raised above the underlying ground surface and supported by the flexible riggings 136*a*, 136*b*. In the third loading position, the height of bucket 605 may be adjusted relative to the elevation of material to be loaded to allow precision loading of the bucket to capture only a portion of a pile or grouping of material.

It shall be appreciated that material loading positions, such as the example illustrated in FIG. 10 or other material loading positions, provide force transfer between the bucket attachment 600 and the work machine 100 in as indicated by force vector F which is at an angle I relative to the work machine 100 and the underlying ground surface GS. The angle I may be 30 degrees or less in some embodiments, 25 degrees or less in some embodiments, or 20 degrees or less in some embodiments. Such material loading positions provide preferred force transfer to work machine 100 during loading of the bucket 605 with a major force component in the Y-axis direction which limits the upward force in the Z-axis direction and the corresponding reduction of traction of the ground contacting wheels of the work machine. Such material loading positions provide preferred force transfer to work machine 100 only at the locations of joints 115*a*, 115*b*, and not at another location. Furthermore, in this positioning, if the bucket 605 is pushed upward in the Z-axis direction (for example, as may occur if the underside of the bucket 605 encounters a rock or other intransigent object when being pushed in a rearward direction) such force is not transferred to work machine 100 by the flexible riggings 136*a*, 136*b* and the net force on the bucket 605 continues to have a major force component in the Y-axis direction which limits the upward force in the Z-axis direction and the corresponding reduction of traction of the ground contacting wheels of the work machine.

It shall be further appreciated that raised material carrying or dumping positions, such as the positions illustrated in FIGS. 6-7 and 8-9, respectively, transfers force from the bucket and its load to the driven rear wheels 106. Thus, when the bucket 605 and any material that it carries are lifted, a weight transfer to the driven rear wheels 106 occurs and the traction, stability, and steering maneuverability of the work machine 100 are increased and enhanced. Such rear end positioning of the bucket attachment 600 relative to the work machine 100 adds traction and control during transport of a load by the bucket 605. In contrast, other positionings of the bucket attachment 600, such as front end positioning, reduce traction, maneuverability, and stability of the work machine 100.

The lift mechanism 120 also provides an example of a lift mechanism that is adjustable to a second position in which the frame 610 is rotated so that the bucket is 605 raised above the underlying ground surface GS and the flexible riggings 136*a*, 136*b* support at least a portion of the weight of the frame 610 and the bucket 605, for example, the position illustrated in FIGS. 6-9 or other raised positions. It shall be appreciated that other embodiments may comprise other types of lift mechanisms, for example, jack devices such as arm type, bottle-type, scissor-type, and other jack types, mechanical linkages, additional or hydraulic or pneumatic adjustment mechanisms, rack, and pinion mechanisms, ratchet mechanisms, screw mechanisms, winch devices including a spool rotatable to wind and unwind a line or other flexible rigging member or other types of lifting members as will occur to one of skill in the art with the benefit of the present disclosure.

A first flexible rigging 136*a* is coupled with and extends between the lifting arm 114 and the frame 610 of the bucket attachment 600. In the illustrated embodiment a second flexible rigging 136*b* is coupled with and extends between the lifting arm 114 and the frame 610 of the bucket attachment 600. In other embodiments, a single flexible rigging may be utilized or more than two flexible rigging members may be utilized. In the illustrated embodiment, the flexible riggings 136*a* and 136*b* comprise lengths of chain. In other embodiments, the flexible riggings 136*a* and 136*b* may comprise cables, lines, ropes, wires, or other types of flexible riggings.

The actuator 122 may be adjusted by operator controls 23 of the work machine 100 which are provided in or proximate an operator cockpit or station and are oriented for manipulation by a human operator facing the front end of the work machine, and which preferably comprise separate controls for raising and lowering the lifting mechanism 120 and bucket attachment 600, and tipping or varying the angle of the bucket 605. The operator controls 23 may be operated to selectably supply pressurized hydraulic fluid to the actuator 122 via hydraulic fluid lines (not illustrated) to expand or contract the length of the actuator 122. In other embodiments, the actuator 122 may be another type of controllable actuator such as an electrically driven controllable actuator or, in principle, a manually driven actuator. Operation of the operator controls 23 to expand the actuator 122 controls the lifting arm 114 to rotate about the joint 105 in a clockwise direction of arrow R1. Operation of the operator controls 23 to contract the actuator 122 controls the lifting arm 114 to rotate about the joint 105 in a counterclockwise direction of arrow R1.

Adjustment of the actuator 122 by operator controls 23 may be performed to raise and lower the bucket attachment relative to an underlying ground surface GS. Starting with the lifting arm 114 in a lowered position with the bucket attachment 600 in contact with the underlying ground surface GS (e.g., the position illustrated in FIGS. 1-2 and 4-5 or other lowered positions), operation of the operator controls 23 to contract the actuator 122 rotates the lifting arm 114 in the counterclockwise direction of arrow R1 to take up any slack present in the flexible riggings 136*a*, 136*b* and, once the flexible riggings 136*a*, 136*b* are taut, to raise the bucket attachment 600 above the underlying ground surface GS by rotation of the bucket attachment 600 about joints 115*a*, 115*b* in a counterclockwise direction of arrow R2. Such adjustment of the actuator 122 may be performed to raise the bucket attachment 600 to a number of raised positions wherein the bucket attachment is raised above and spaced apart from the underlying ground surface GS (e.g., the position illustrated in FIGS. 6-9 or other raised positions).

Figure 3:
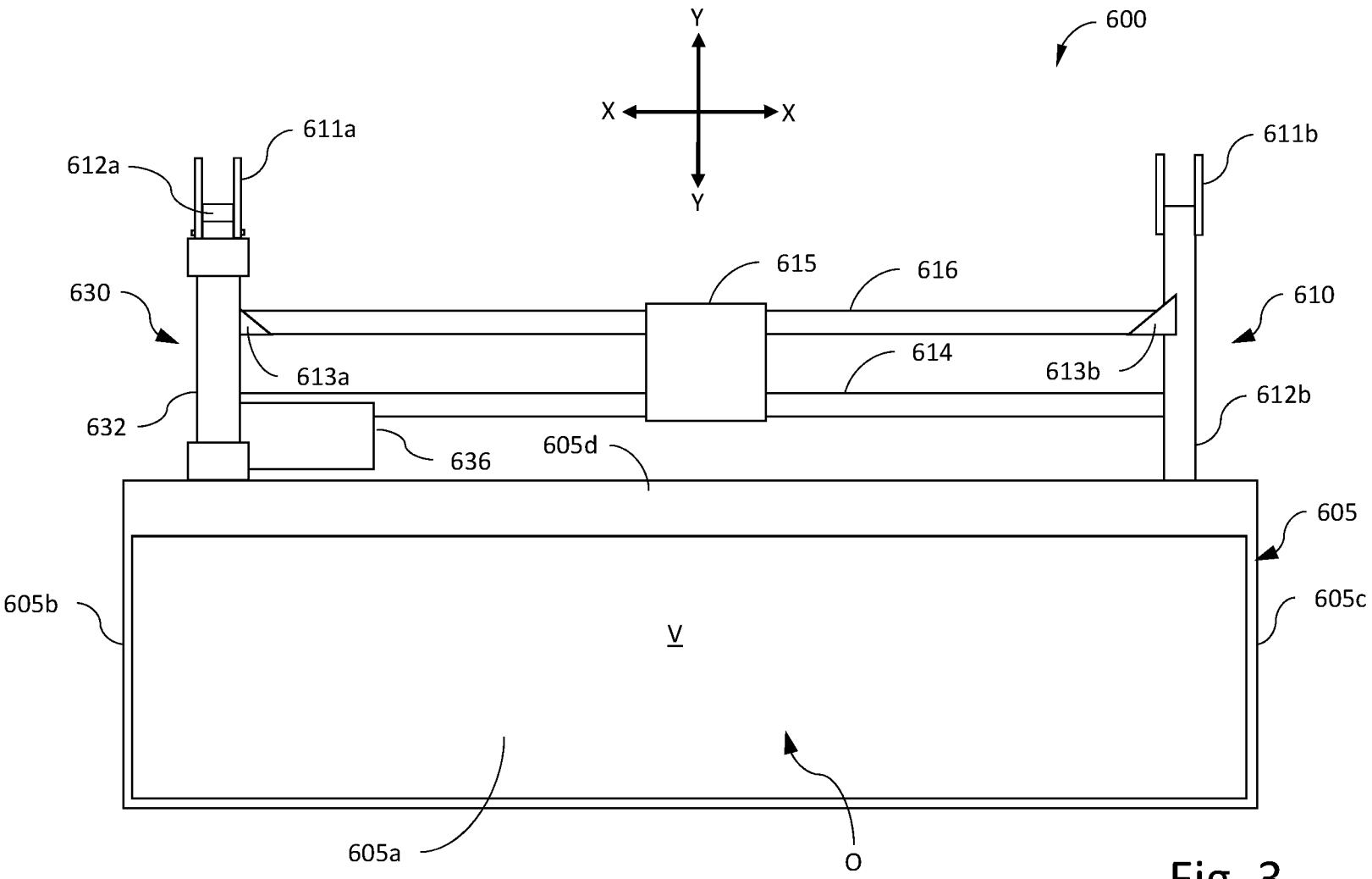
FIG. 3 is a top view of the bucket attachment of FIG. 1.
Figure 4:
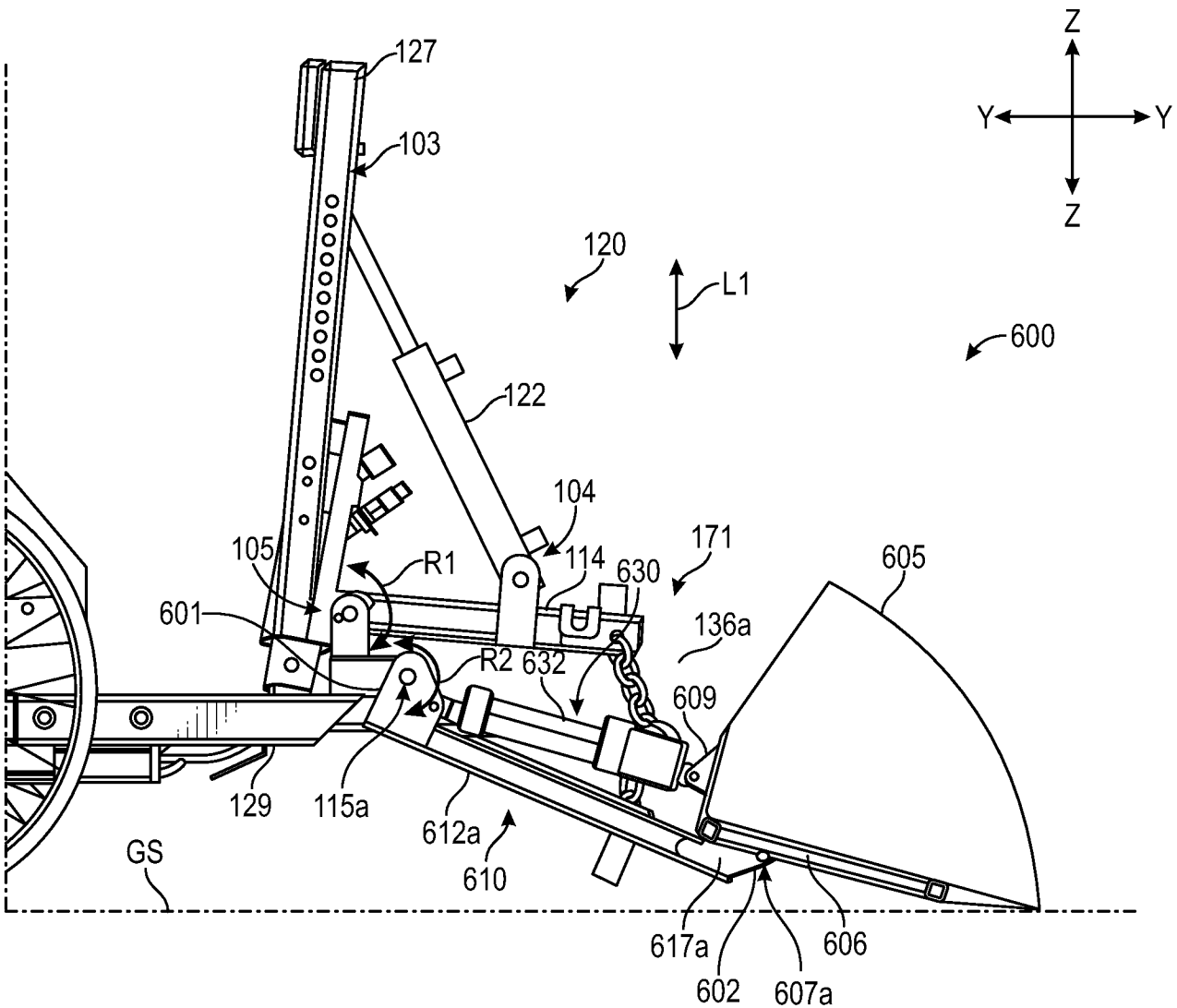
FIG. 4 is a side view of a portion of the example system of FIG. 1 in a first state of adjustment.
Figure 5:
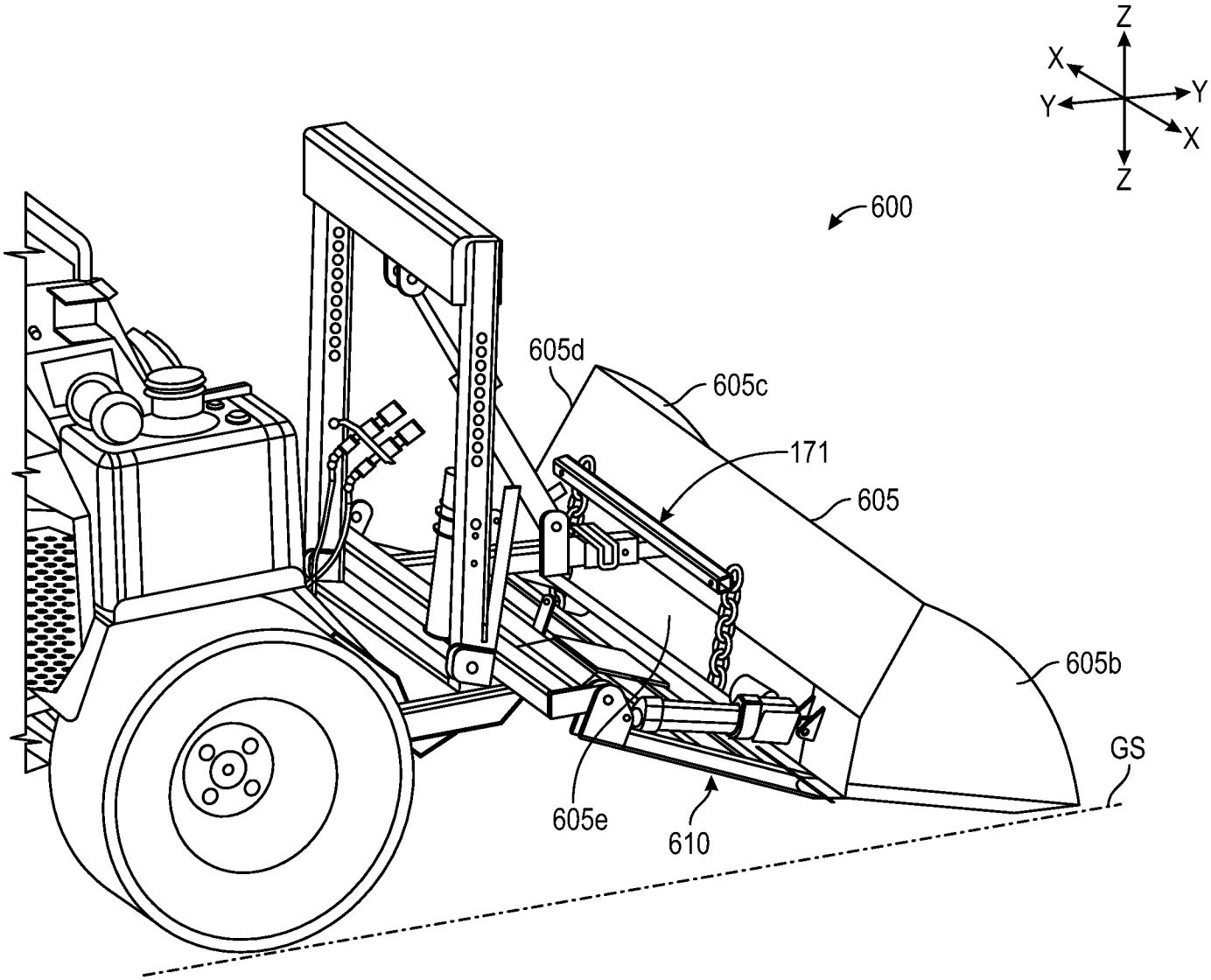
FIG. 5 is a perspective view of a portion of the example system of FIG. 1 in the first state of adjustment.

As illustrated in isolation in FIG. 3, the bucket attachment 600 includes a frame 610 operatively coupled with a bucket 605. The frame 610 extends between a frame front end 601 and a frame rear end 602. The bucket 605 is rotatably coupled with the frame rear end 602. The frame 610 includes longitudinal frame members 612*a*, 612*b* which are coupled with lateral frame members 614, 616. Angle reinforcement members 613*a*, 613*b* are coupled with longitudinal frame members 612*a*, 612*b*, and with lateral frame member 616. A stabilization bracket 615 is coupled with and extends between the lateral frame member 614 and the lateral frame member 616. The frame front end 601 of the frame 610 is rotatably coupled with the rear end 22 of the work machine 100 by joints 115*a*, 115*b* which are positioned at first and second locations spaced apart along the width W of the work machine 100. In the illustrated embodiment, the joints 115*a*, 115*b* are provided as hinge-type joints comprising frame joint members 611*a*, 611*b* which are rotatably coupled with machine joint members 139*a*, 139*b* by coupling pins 169*a*, 169*b*, respectively. Machine joint members 139*a*, 139*b* are coupled with draw bar 138 at the rear end 22 of work machine 100. It shall be appreciated that other embodiments may utilize other types of joints accommodating or providing the described relative rotation of structures.

The bucket 605 includes a bucket bottom 605*a* and a plurality of bucket sides 605*b*, 605*c*, 605*d*, 605*e*, defining an interior volume V and an opening 0 facing the interior volume V. The bucket 605 is rotatably coupled with the frame 610 by joints 607*a*, 607*b* which accommodate and provide rotation of the bucket 605 relative to the frame 610. In the illustrated embodiment, the joints 607*a*, 607*b* are provided as hinge-type joints comprising frame joint members 617*a*, 617*b* which are rotatably coupled with bucket joint members 606*a*, 606*b* by respective coupling pins. It shall be appreciated that other embodiments may utilize other types of joints accommodating or providing the described relative rotation of structures.

A bucket actuation system 630 is operatively coupled with the bucket 605 and the frame 610. The bucket actuation system 630 includes an electric motor 636 which is operatively coupled with and configured to drive a bucket actuator 632. In other embodiments, the bucket actuation system may utilize other types of actuation elements, such as hydraulic actuators or, in principle, manual actuators. The bucket actuator 632 is rotatably coupled with the bucket 605 by a joint 609 which permits rotation of the bucket 605 relative to the bucket actuator 632 in the direction of arrow R4. The bucket actuator 632 is also rotatably coupled with the frame 610 by a joint 135 which permits rotation of the bucket actuator 632 relative to the frame 610 in the direction of arrow R3.

The bucket actuation system 630 may be adjusted by operator controls 23 (which may include separate controls for bucket lifting and for bucket tipping as well as other separate controls) of the work machine 100 which may be operated to selectably control the electric motor 636 to expand or contract the length of the bucket actuator 632. Operation of the operator controls 23 to expand the bucket actuator 632 controls the bucket 605 to rotate about the joints 607*a*, 607*b* in a clockwise direction of arrow R4. Operation of the operator controls 23 to contract the bucket actuator 632 controls the bucket 605 to rotate about the joints 607*a*, 607*b* in a counterclockwise direction of arrow R4.

The bucket actuation system 630 may be adjusted by operator controls 23 to vary the angle of the bucket 605 when the bucket 605 is in a plurality Z-axis positions, including raised and lowered positions. For example, starting from a position in which the bucket 605 is raised above the underlying ground surface GS and the bucket 605 is rotated to a load-carrying angle with the opening 0 facing generally upward in the Z-axis direction (e.g., the position illustrated in FIGS. 6-7 or other load-carrying positions at various Z-axis elevations), the bucket actuation system 630 may be adjusted by operator controls 23 to extend the bucket actuator 632 and rotate the bucket 605 about the joints 607*a*, 607*b* in a clockwise direction of arrow R4 to a tipped or dumping position (e.g., to the position illustrated in FIGS. 8-9 or another tipped or dumping position).

Figure 6:
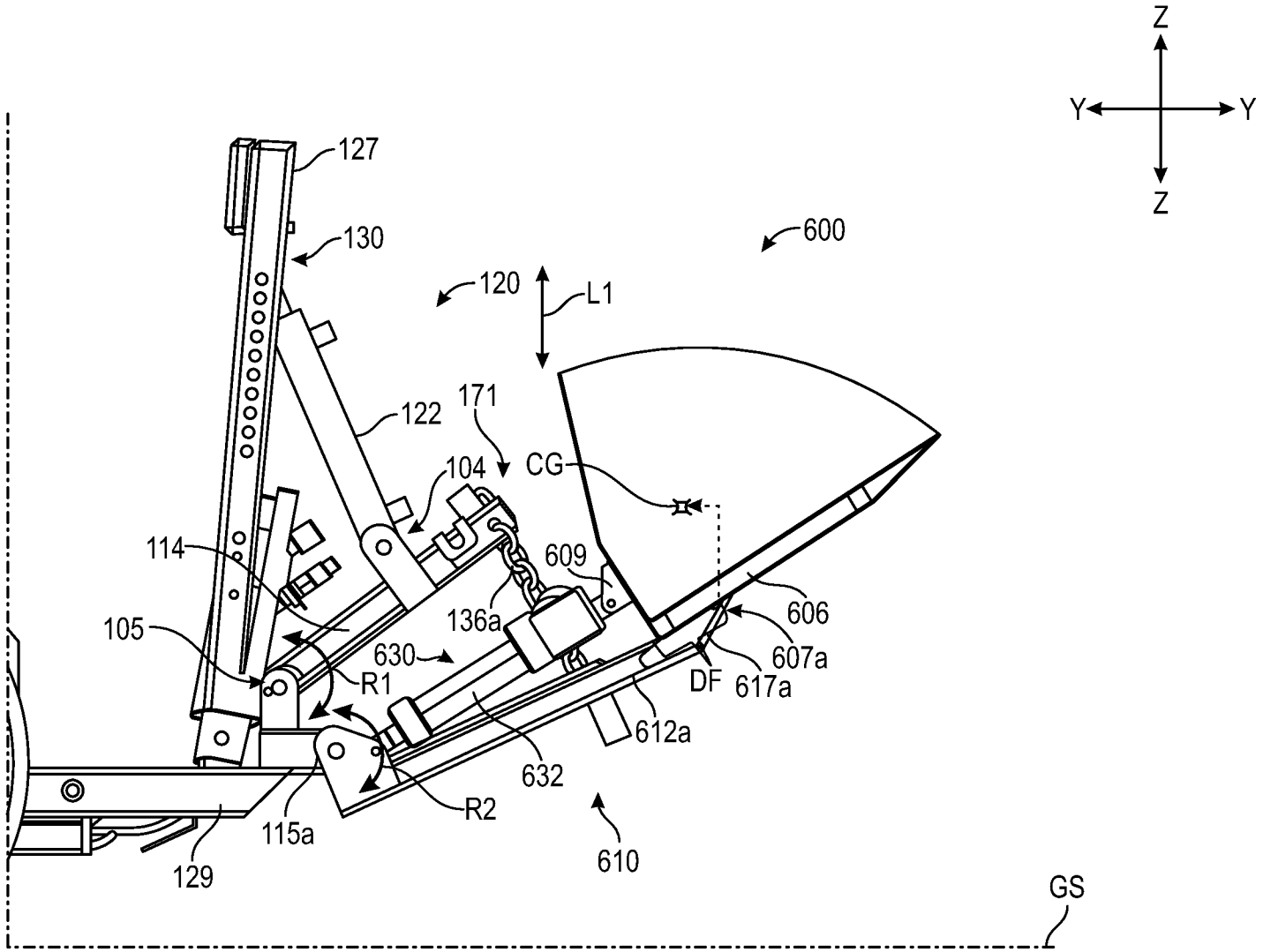
FIG. 6 is a side view of a portion of the example system of FIG. 1 in a second state of adjustment.

As illustrated most plainly in connection with FIG. 6, the connection point of joints 607*a*, 607*b* with the bucket 605 is positioned such that the center of gravity CG of the bucket when loaded and adjusted to the illustrated carrying position is forward in the Y-axis direction from the connection point of joints 607*a*, 607*b*. For example, in the illustrated embodiment, the connection point of joints 607*a*, 607*b* along the bottom surface 605*a* of the bucket 605 spaced rearward of the forward most extremity of the bucket 605 the bottom surface 605*a* of the bucket 605 by a distance DF. By this positioning, the weight of the bucket and its load in a carrying position is shifted forward relative to the connection points of joints 607*a*, 607*b* so that the tendency of this weight to tip the bucket 605 downward from a carrying position to a dumping position is reduced. This, in turn, allows a lower force actuator to be used in connection with the bucket actuation system 630 and also facilitates the partial tipping of the bucket 605 to a position intermediate the positions illustrated allowing partial tipping of the bucket to release a partial or measured amount of the load carried by the bucket.

Figure 7:
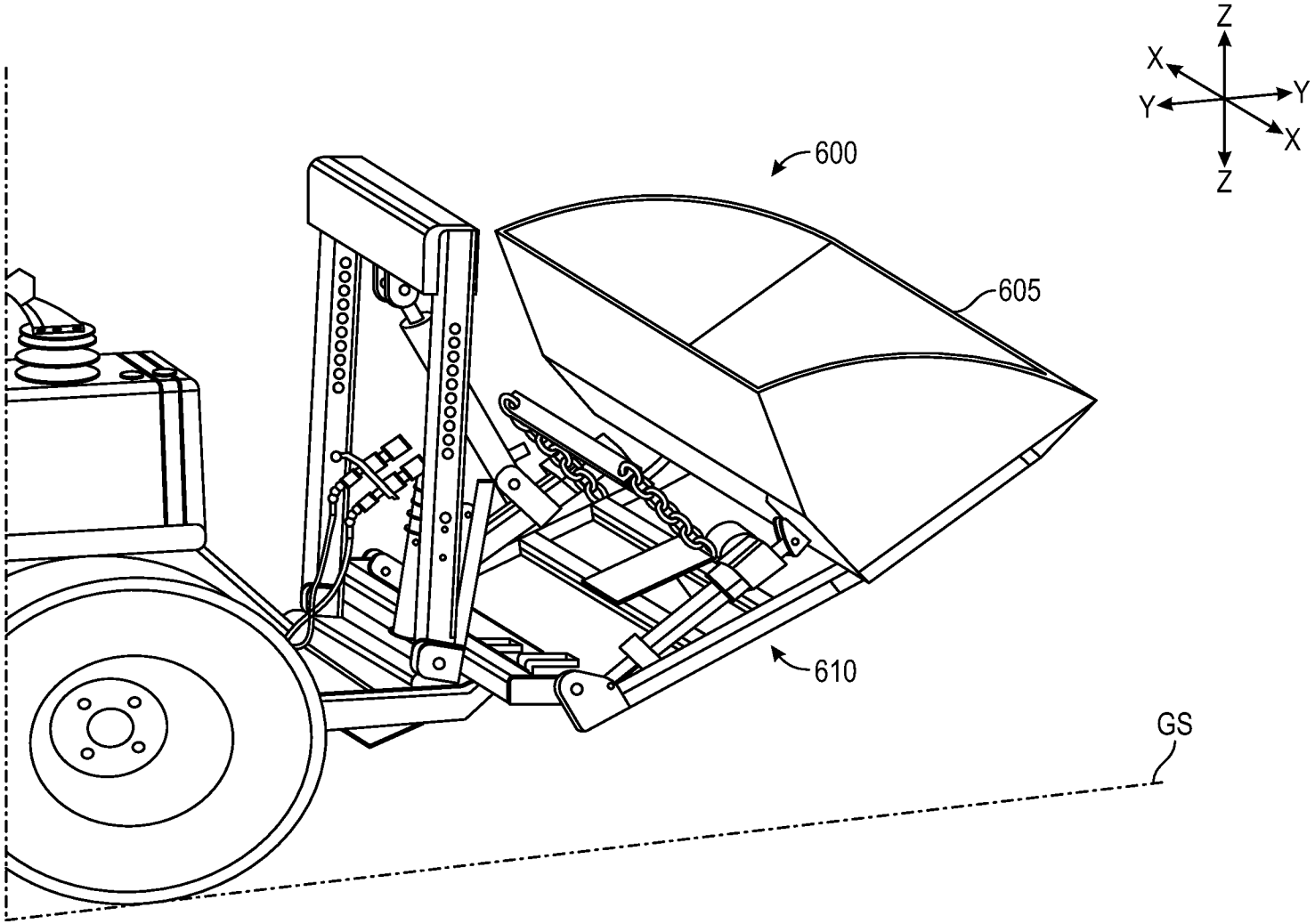
FIG. 7 is a perspective view of a portion of the example system of FIG. 1 in the second state of adjustment.
Figure 8:
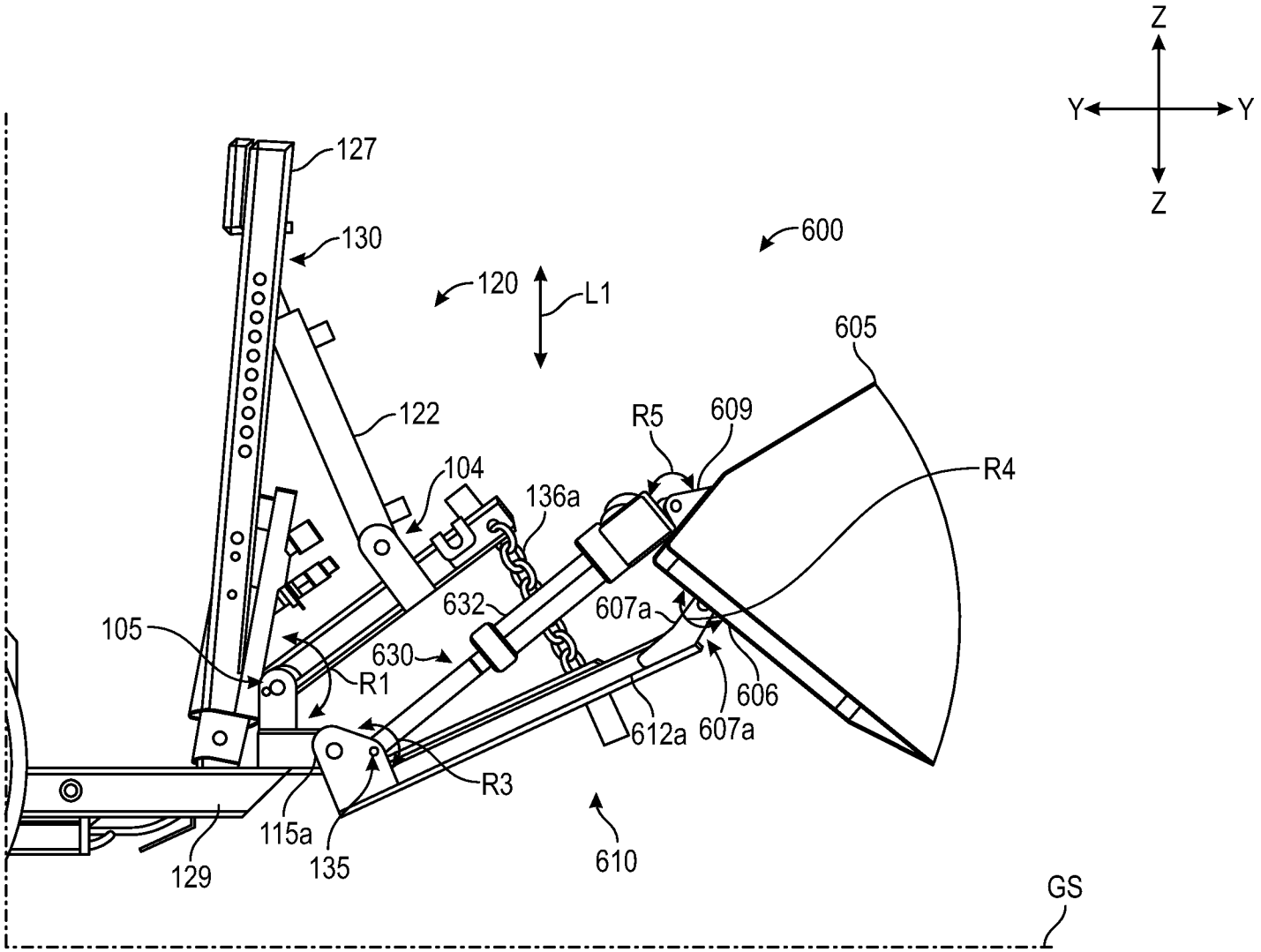
FIG. 8 is a side view of a portion of the example system of FIG. 1 in a third state of adjustment.
Figure 9:
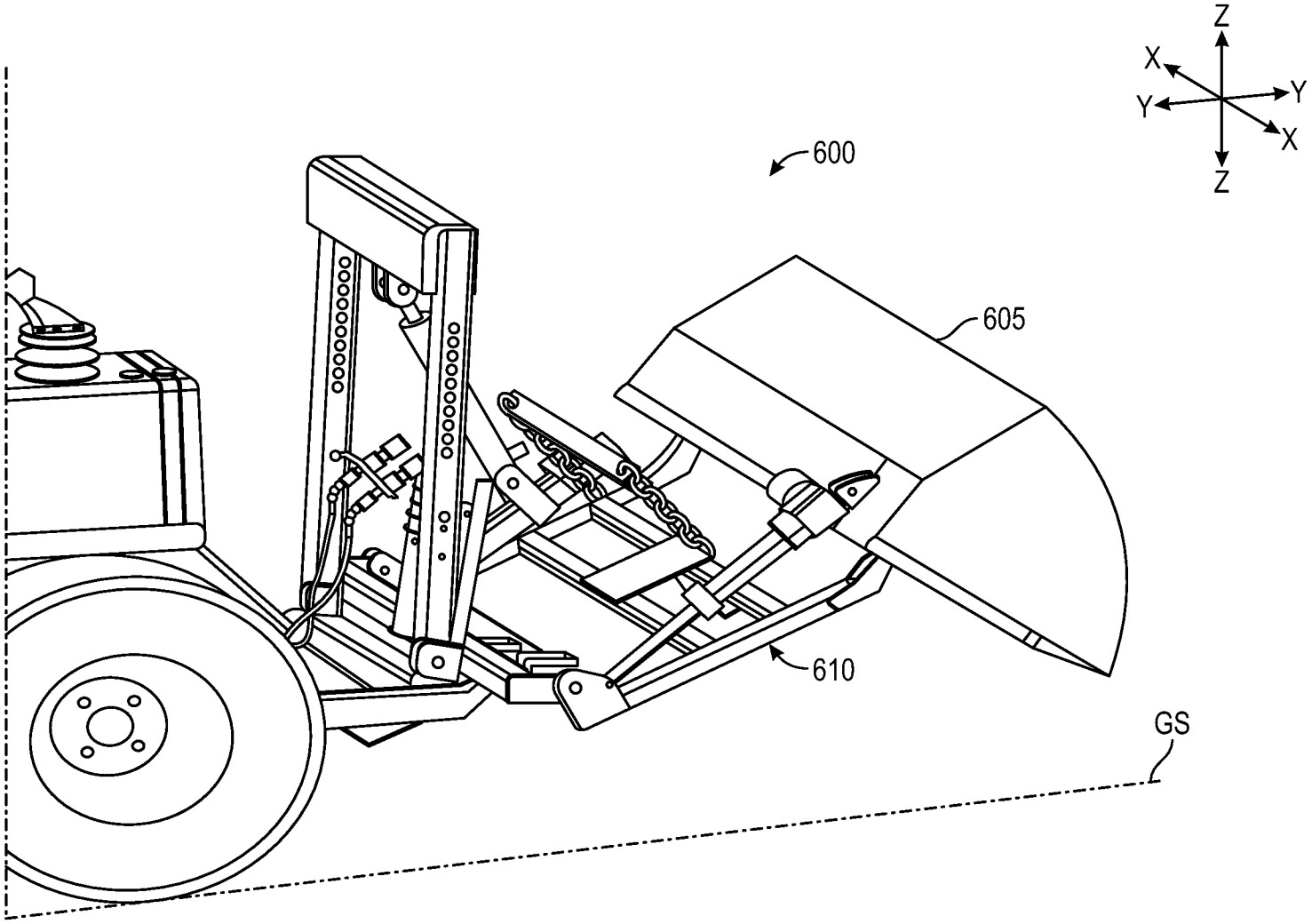
FIG. 9 is a perspective view of a portion of the example system of FIG. 1 in the third state of adjustment.

It shall be appreciated that adjustment between a raised carrying position such as the position illustrated in FIGS. 6-7 and to a raised tipped or dumping position such as the position illustrated in FIGS. 8-9 is an example of rotation or tipping of the bucket 605 from a first bucket position in which the opening 0 of the bucket 605 is positioned entirely above the bottom 605*a* of the bucket 605 in the Z-axis direction to a second bucket position in which at least a portion of the opening 0 is positioned below at least a portion of the bucket bottom 605 in the Z-axis direction effective to dump or unload material which may be present in the interior volume V of the bucket.

It shall be appreciated that number of structural components or elements disclosed herein are described as being attached, coupled, or joined to one another or as attaching, coupling, or joining other structural components or elements which shall be understood to encompass a number of attachments, coupling, or joining structures and techniques, for example, adhesion, bolting, bonding, brazing, clamping, formation as an integral or unitary structure with coupled portions, screwing, riveting, welding or other attachment, coupling or joining techniques as will occur to one of skill in the art with the benefit of the present disclosure except as otherwise expressly or logically limited or excluded. The assemblies of components disclosed herein are likewise understood to encompass such attachment or coupling structures and techniques except as otherwise expressly or logically limited or excluded.

While exemplary embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred, or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. An apparatus comprising:

a work machine including a front end, a rear end, and a plurality of ground-contacting wheels rotatable to turn the work machine about a zero turning radius, and extending along a width in an X-axis direction, a length in a Y-axis direction, and a height in a Z-axis direction;

a lift mechanism adjustably coupled with the work machine, the lift mechanism being adjustable to a plurality of Z-axis positions;

a bucket attachment including a frame and a bucket rotatably coupled with the frame at a connection point along a surface of the bucket spaced rearward in the Y-axis direction of a forward most extremity of the bucket such that the bucket is rotatable about the connection point to a load carrying position wherein a center of gravity of the bucket when loaded is forward in the Y-axis direction from the connection point, the frame being rotatably coupled with the rear end of the work machine at first and second locations spaced apart along the width of the work machine and coupled with the lift mechanism by at least one flexible rigging;

the lift mechanism being adjustable to a first position in which the frame is rotated so that the bucket contacts an underlying ground surface and the at least one flexible rigging does not support any of a weight of the frame; and the lift mechanism being adjustable to a second position in which the frame is rotated so that the bucket is raised above the underlying ground surface and the at least one flexible rigging supports at least a portion of the weight of the frame.

2. The apparatus of claim 1, wherein the lift mechanism comprises a lift arm rotatably coupled with the work machine and an actuator rotatably coupled with the lift arm and the work machine, the actuator being actuatable to rotate the lift arm to the plurality of Z-axis positions.

3. The apparatus of claim 1, wherein the frame of the bucket attachment extends between a frame front end and a frame rear end, the frame front end is rotatably coupled with the rear end of the work machine at said first and second locations, and the bucket is rotatably coupled with the frame rear end.

4. The apparatus of claim 1, wherein the bucket includes a bottom and a plurality of sides defining an interior volume and an opening facing the interior volume.

5. The apparatus of claim 4, wherein with the lift mechanism adjusted to the first position and the frame rotated so that the bucket contacts the underlying ground surface, at least a portion of at least one of the plurality of sides of the bucket contacts the underlying ground surface and the bucket is oriented to receive material through the opening in the Y-axis direction.

6. The apparatus of claim 4, wherein with the lift mechanism adjusted to the second position and the frame rotated so that the bucket is raised above the underlying ground surface, the bucket is rotatable from a first bucket position in which the opening is positioned entirely above the bottom of the bucket to a second bucket position in which at least a portion of the opening is positioned below at least a portion of the bottom of the bucket.

7. The apparatus of claim 6, comprising a bucket actuator operatively coupled with the bucket and the frame and configured to tilt the bucket relative to the frame.

8. The apparatus of claim 1, wherein with the lift mechanism adjusted to the first position and the frame rotated so that the bucket contacts the underlying ground surface, force transfer between the bucket and the work machine is limited to the first and second locations spaced apart along the width of the work machine.

9. The apparatus of claim 8, wherein the force transfer to the bucket comprises a vector angled +/−30 degrees or less relative to the Y-axis direction.

10. The apparatus of claim 1, comprising a cockpit and operator controls oriented for manipulation by a human operator facing the front end.

11. Apparatus of claim 1, comprising the work machine.

12. An apparatus for coupling a work machine with a bucket attachment, the apparatus comprising:

a lift mechanism adjustably coupled with the work machine, the lift mechanism being adjustable to a plurality of Z-axis positions of an X-Y-Z coordinate system;

a bucket attachment including a frame and a bucket rotatably coupled with the frame, the frame being configured to rotatably couple with a rear end of the work machine at first and second locations spaced apart along a width of the work machine and being coupled with the lift mechanism by at least one flexible rigging, a connection point between the bucket and the frame being spaced rearward of a forward most extremity of the bucket, the bucket being rotatable about the connection point to a load carrying position wherein a center of gravity of the bucket is forward in the Y-axis direction from the connection point;

the lift mechanism being adjustable to a first position in which the frame is rotated so that the bucket contacts an underlying ground surface and the at least one flexible rigging does not support any of a weight of the frame; and the lift mechanism being adjustable to a second position in which the frame is rotated so that the bucket is raised above the underlying ground surface and the at least one flexible rigging supports at least a portion of the weight of the frame.

13. The apparatus of claim 12, wherein the lift mechanism comprises a lift arm configured to be rotatably coupled with the work machine and an actuator rotatably coupled with the lift arm and configured to be rotatably coupled with the work machine, the actuator being actuatable to rotate the lift arm to the plurality of Z-axis positions.

14. The apparatus of claim 12, wherein the frame of the bucket attachment extends between a frame front end and a frame rear end, the frame front end is configured to be rotatably coupled with the rear end of the work machine at said first and second locations, and the bucket is rotatably coupled with the frame rear end.

15. The apparatus of claim 12, wherein the bucket includes a bottom and a plurality of sides defining an interior volume and an opening facing the interior volume.

16. The apparatus of claim 15 wherein with the lift mechanism adjusted to the first position and the frame rotated so that the bucket contacts the underlying ground surface, at least a portion of at least one of the plurality of sides of the bucket contacts the underlying ground surface and the bucket is oriented to receive material through the opening in a Y-axis direction.

17. The apparatus of claim 15, wherein with the lift mechanism adjusted to the second position and the frame rotated so that the bucket is raised above the underlying ground surface, the bucket is rotatable from a first bucket position in which the opening is positioned entirely above the bottom of the bucket to a second bucket position in which at least a portion of the opening is positioned below at least a portion of the bottom of the bucket.

18. The apparatus of claim 17, comprising a bucket actuator operatively coupled with the bucket and the frame and configured to tilt the bucket relative to the frame.

19. The apparatus of claim 12, wherein with the lift mechanism adjusted to the first position and the frame rotated so that the bucket contacts the underlying ground surface, force transfer between the bucket and a point at which the bucket attachment is configured to couple with the work machine is limited to the first and second locations spaced apart along the width of the work machine.

20. The apparatus of claim 19, wherein the force transfer to the bucket comprises a vector angled +/−20 degrees or less relative to a Y-axis direction.

* * * * *